US008226215B2

(12) United States Patent
Bechler et al.

(10) Patent No.: US 8,226,215 B2
(45) Date of Patent: Jul. 24, 2012

(54) JETTING MODULE INSTALL MECHANISM

(75) Inventors: Russell A. Bechler, Bellbrook, OH (US); Douglas E. Schultz, Dayton, OH (US)

(73) Assignee: Eastman Kodak Company, Rochester, NY (US)

( * ) Notice: Subject to any disclaimer, the term of this patent is extended or adjusted under 35 U.S.C. 154(b) by 347 days.

(21) Appl. No.: 12/707,704

(22) Filed: Feb. 18, 2010

(65) Prior Publication Data

US 2011/0199434 A1 Aug. 18, 2011

(51) Int. Cl.
*B41J 2/02* (2006.01)

(52) U.S. Cl. ..... 347/73; 347/108

(58) Field of Classification Search ..... 347/73–78, 347/108

See application file for complete search history.

(56) References Cited

U.S. PATENT DOCUMENTS 1,941,001 A 12/1933 Hansell
3,373,437 A 3/1968 Sweet et al.
5,682,191 A * 10/1997 Barrett et al. ..... 347/104
2009/0295878 A1 12/2009 Hanchak et al.
* cited by examiner

*Primary Examiner* — Lamson Nguyen
(74) *Attorney, Agent, or Firm* — Peyton C. Watkins

(57) ABSTRACT

A printer includes a plurality of jetting modules each including a first alignment feature, a plurality of nozzles through which fluid may be jetted and fluid and electrical connections; a printhead frame having a plurality of jetting-module receiving receptacles each of which receives one of the jetting modules, each receiving receptacle having a second alignment feature corresponding to the first alignment feature of a jetting module: a jetting module installation device having a pocket for receiving a jetting module, wherein the jetting module installation device includes a latch mechanism that, in a first position, is latched to the printhead frame securing the jetting module in a jetting module receiving receptacle with the first alignment feature engaging a corresponding second alignment feature of the printhead frame; the latch mechanism that, in a second position, is unlatched from the printhead frame so that the jetting module is not secured in the jetting module receiving receptacle; and wherein the jetting module installation device includes a coupling frame having fluid and electrical connections that correspond to the fluid and electrical connections of the jetting module, and the installation device includes a mechanism move the coupling frame relative to the jetting module to cause the fluid and electrical connections of the coupling frame to mate to the fluid and electrical connections of the jetting module.

19 Claims, 10 Drawing Sheets

JETTING MODULE INSTALL MECHANISM

FIELD OF THE INVENTION

This invention relates generally to the field of digitally controlled printing devices, such as continuous ink jet printers. More specifically, the invention relates to a method for installing and properly aligning field-replaceable jetting modules in which the jetting modules are spaced densely within the ink jet printer.

BACKGROUND OF THE INVENTION

Traditionally, digitally controlled color printing capability is accomplished by one of two technologies. Both require independent ink supplies for each of the colors of ink provided. Ink is fed through channels formed in the printhead. Each channel includes a nozzle from which droplets of ink are selectively extruded and deposited upon a medium. Typically, each technology requires separate ink delivery systems for each ink color used in printing. Ordinarily, the three primary subtractive colors, i.e. cyan, yellow and magenta, are used because these colors can produce, in general, up to several million shades or color combinations.

The first technology, commonly referred to as "drop on demand" ink jet printing, selectively provides ink droplets for impact upon a recording surface using a pressurization actuator (thermal, piezoelectric, etc.). Selective activation of the actuator causes the formation and ejection of a flying ink droplet that crosses the space between the printhead and the print media and strikes the print media. The formation of printed images is achieved by controlling the individual formation of ink droplets, as is required to create the desired image. Typically, a slight negative pressure within each channel keeps the ink from inadvertently escaping through the nozzle, and also forms a slightly concave meniscus at the nozzle helping to keep the nozzle clean.

Conventional, droplet-on-demand ink jet printers utilize a heat actuator or a piezoelectric actuator to produce the ink jet droplet at orifices of a print head. With heat actuators, a heater, placed at a convenient location, heats the ink to cause a localized quantity of ink to phase change into a gaseous steam bubble that raises the internal ink pressure sufficiently for an ink droplet to he expelled. With piezoelectric actuators, a mechanical force causes an ink droplet to he expelled.

The second technology, commonly referred to as "continuous stream" or simply "continuous" ink jet printing, uses a pressurized ink source that produces a continuous stream of ink droplets. Traditionally. the ink droplets are selectively electrically charged. Deflection electrodes direct those droplets that have been charged along a flight path different from the flight path of the droplets that have not been charged. Either the deflected or the non-deflected droplets can he used to print on receiver media while the other droplets go to an ink capturing mechanism (catcher, interceptor, gutter, etc.) to be recycled or disposed. U.S. Pat. No. 1,941,001, issued to Hansell, on Dec. 26, 1933, and U.S. Pat. No. 3,373,437 issued to Sweet et al., on Mar. 12, 1968, each disclose an array of continuous ink jet nozzles wherein ink droplets to be printed arc selectively charged and deflected towards the recording medium.

Continuous ink jet printing systems use jetting modules to eject the droplet toward the print media. These units contain the electrical and fluid connections necessary for the jetting module to properly function. As can he expected, occasionally the jetting modules may need replacing due to normal wear and tear.

Commonly assigned U.S. patent application 2009/0295878 discloses a continuous inkjet printing system having a method and apparatus for replacing jetting modules. This disclosure is more than sufficient for some ink jet printers: however, in continuous ink jet printers having the jetting modules densely populated, additional complexities arise. For example, proper alignment of the print head to the deflection mechanism is even more technically demanding. Without belaboring each additional complexity, and as may be expected, it is sufficient to note that proper alignment of other components may also be more demanding.

Although the above described system is satisfactory, improvements in installing jetting modules for overcoming the above shortcomings are always desirable.

SUMMARY OF THE INVENTION

The present invention is directed to overcoming one or more of the problems set forth above. Briefly summarized, according to one aspect of the invention, the invention resides in a printer comprising (a) a plurality of jetting modules each including a first alignment feature, a plurality of nozzles through which fluid may be jetted and fluid and electrical connections; (b) a printhead frame having a plurality of jetting-module receiving receptacles each of which receives one of the jetting modules, each receiving receptacle having a second alignment feature corresponding to the first alignment feature of a jetting module: (c) a jetting module installation device having a pocket for receiving a jetting module, wherein the jetting module installation device includes a latch mechanism that, in a first position, is latched to the printhead frame securing the jetting module in a jetting module receiving receptacle with the first alignment feature engaging a corresponding second alignment feature of the printhead frame; (d) the latch mechanism that, in a second position, is unlatched from the printhead frame so that the jetting module is not secured in the jetting module receiving receptacle; and wherein the jetting module installation device includes a coupling frame having fluid and electrical connections that correspond to the fluid and electrical connections of the jetting module, and the installation device includes a mechanism move the coupling frame relative to the jetting module to cause the fluid and electrical connections of the coupling frame to mate to the fluid and electrical connections of the jetting module.

BRIEF DESCRIPTION OF THE DRAWINGS

The above and other objects, features, and advantages of the present invention will become more apparent when taken in conjunction with the following description and drawings wherein identical reference numerals have been used, where possible, to designate identical features that are common to the figures, and wherein.

While the specification concludes with claims particularly pointing out and distinctly claiming the subject matter of the present invention, it is believed that the invention will he better understood from the following description when taken in conjunction with the accompanying drawings, wherein:

DETAILED DESCRIPTION OF THE INVENTION

Figure 1:
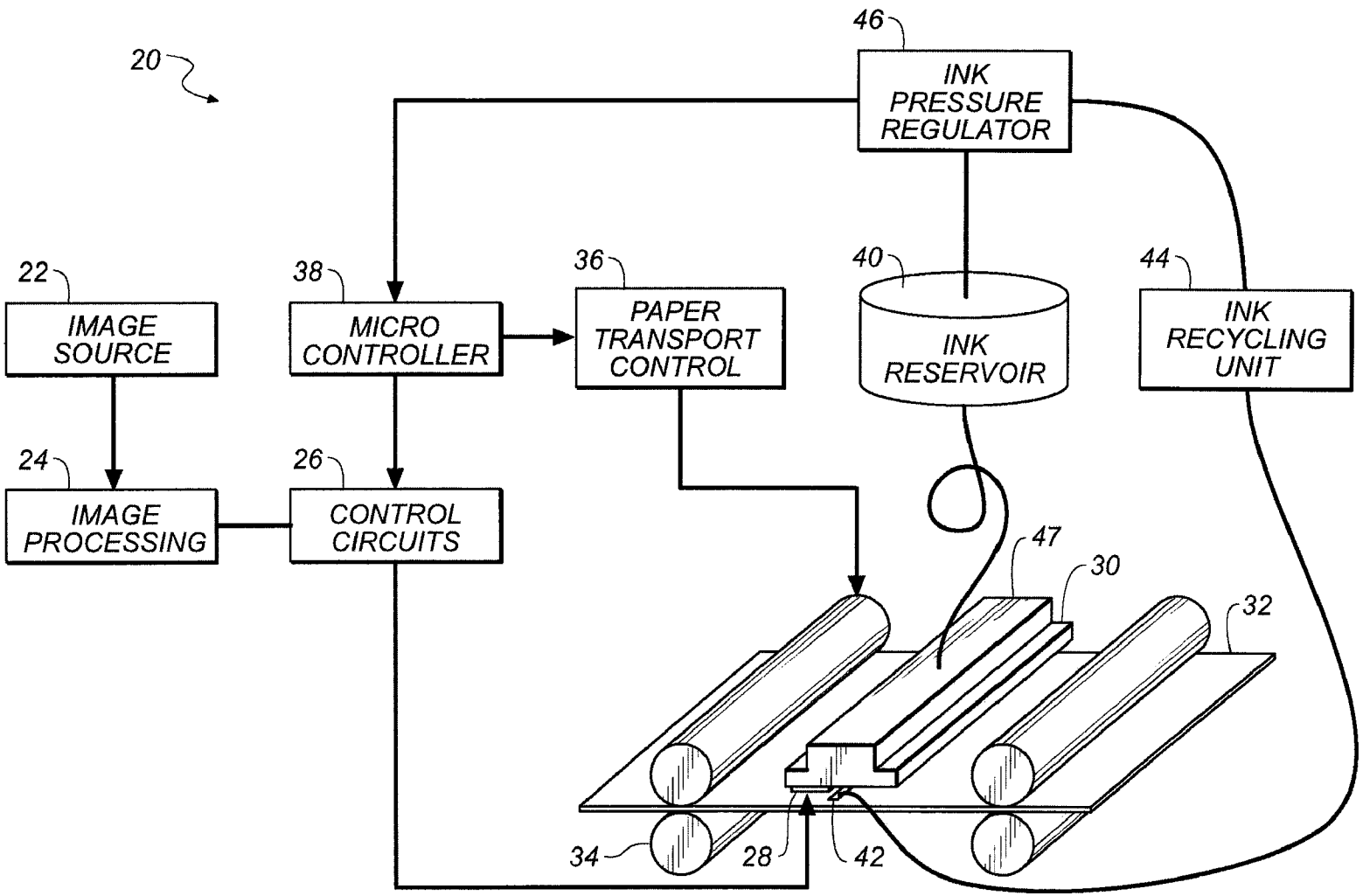
FIG. 1 shows a simplified block schematic diagram of an example embodiment of a printer system made in accordance with the present invention.

The present description will he directed in particular to elements forming part of, or cooperating more directly with, apparatus in accordance with the present invention. It is to be understood that elements not specifically shown or described may take various forms well known to those skilled in the art. In the following description and drawings, identical reference numerals have been used, where possible, to designate identical elements.

The example embodiments of the present invention are illustrated schematically and not to scale for the sake of clarity. One of the ordinary skills in the art will he able to readily determine the specific size and interconnections of the elements of the example embodiments of the present invention.

As described herein, the example embodiments of the present invention provide a printhead or printhead components typically used in inkjet printing systems. However, many other applications are emerging which use inkjet printheads to emit liquids (other than inks) that need to be finely metered and deposited with high spatial precision. As such, as described herein, the terms "liquid" and "ink" refer to any material that can be ejected by the printhead or printhead components described below.

Referring to FIG. 1, a continuous ink jet printer system 20 includes an image source 22 such as a scanner or computer which provides raster image data, outline image data in the form of a page description language, or other forms of digital image data. This image data is converted to half-toned bitmap image data by an image processing unit 24 which also stores the image data in memory. A plurality of drop forming mechanism control circuits 26 read data from the image memory and applies time-varying electrical pulses to a drop forming mechanism(s) 28 that are associated with one or more nozzles of a printhead 30. These pulses are applied at an appropriate time, and to the appropriate nozzle, so that drops formed from a continuous ink jet stream will form spots on a recording medium 32 in the appropriate position designated by the data in the image memory.

Recording medium 32 is moved relative to printhead 30 by a recording medium transport system 34, which is electronically controlled by a recording medium transport control system 36, and which in turn is controlled by a micro-controller 38. The recording medium transport system shown in FIG. 1 is a schematic only, and many different mechanical configurations are possible. For example, a transfer roller could be used as recording medium transport system 34 to facilitate transfer of the ink drops to recording medium 32. Such transfer roller technology is well known in the art. In the case of page width printheads, it is most convenient to move recording medium 32 past a stationary printhead. However in the case of scanning print systems, it is usually most convenient to move the printhead along one axis (the sub-scanning direction) and the recording medium along an orthogonal axis (the main scanning direction) in a relative raster motion.

Ink is contained in an ink reservoir 40 under pressure. In the non-printing state, continuous ink jet drop streams are unable to reach recording medium 32 due to an ink catcher 42 that blocks the stream and which may allow a portion of the ink to be recycled by an ink recycling unit 44. The ink recycling unit reconditions the ink and feeds it back to reservoir 40. Such ink recycling units are well known in the art. The ink pressure suitable for optimal operation will depend on a number of factors, including geometry and thermal properties of the nozzles and thermal properties of the ink. A constant ink pressure can be achieved by applying pressure to ink reservoir 40 under the control of ink pressure regulator 46.

The ink is distributed to printhead 30 through an ink channel 47. The ink preferably flows through slots or holes etched through a silicon substrate of printhead 30 to its front surface, where a plurality of nozzles and drop forming mechanisms, for example, heaters, are situated. When printhead 30 is fabricated from silicon, drop forming mechanism control circuits 26 can be integrated with the printhead. Printhead 30 also includes a deflection mechanism (not shown in FIG. 1) which is described in more detail below with reference to FIGS. 2 and 3.

Figure 2:
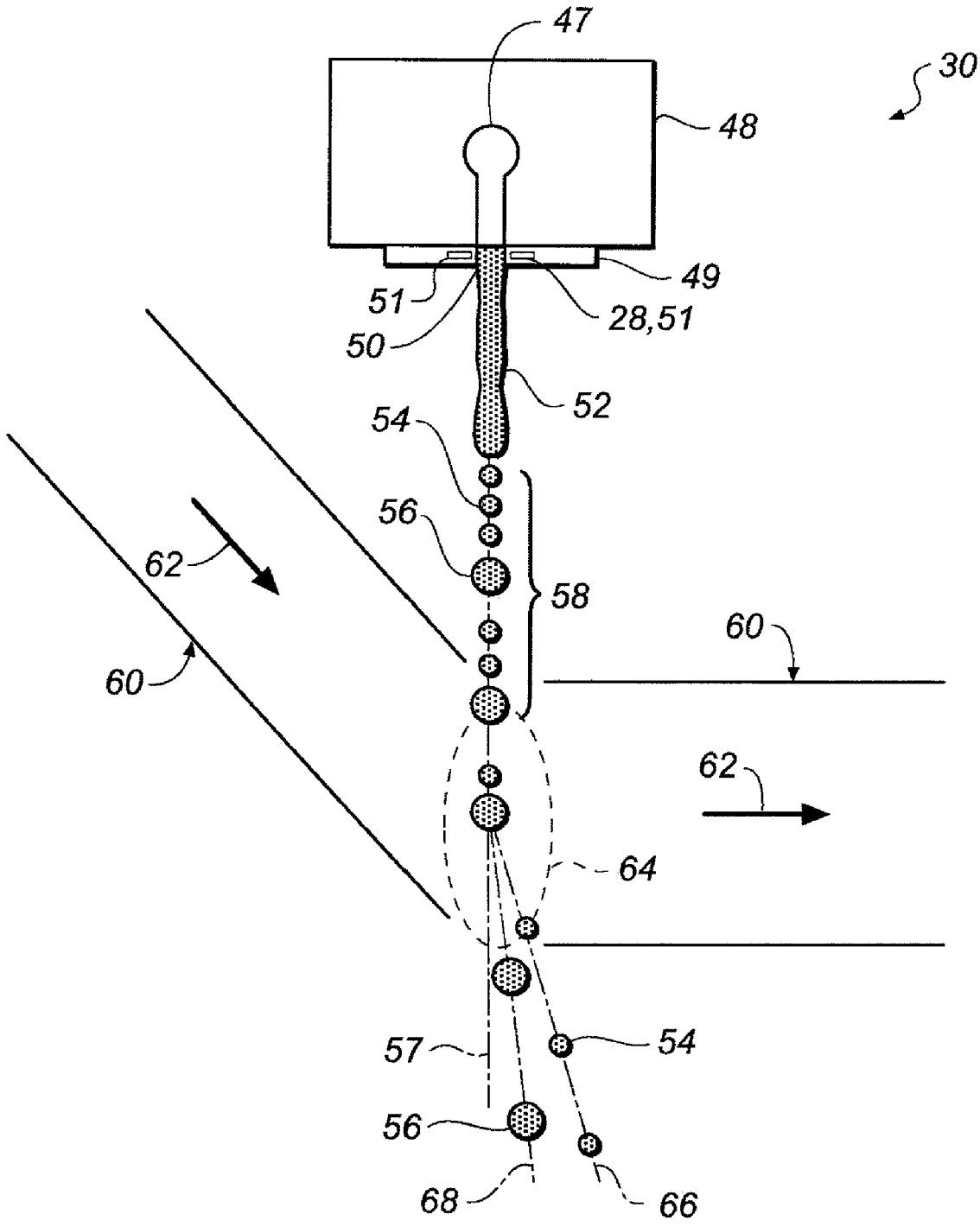
FIG. 2 is a schematic view of an example embodiment of a continuous printhead made in accordance with the present invention.

Referring to FIG. 2, a schematic view of a continuous liquid printhead 30 is shown. A jetting module 48 of printhead 30 includes an array or a plurality of nozzles 50 formed in a nozzle plate 49. In FIG. 2, nozzle plate 49 is affixed to jetting module 48. However, if preferred, nozzle plate 49 can be integrally formed with jetting module 48.

Liquid, for example, ink, is emitted under pressure through each nozzle 50 of the array to form filaments of liquid 52. In FIG. 2, the array or plurality of nozzles extends into and out of the figure and preferably the nozzle array is a linear array of nozzles.

Jetting module 48 is operable to form liquid drops having a first size and liquid drops having a second size through each nozzle. To accomplish this, jetting module 48 includes a drop stimulation or drop forming device or transducer 28, for example, a heater. piezoelectric transducer, EHD transducer and a MEMS actuator, that, when selectively activated perturbs each filament of liquid 52, for example, ink, to induce portions of each filament to break off from the filament and coalesce to form drops 54, 56.

In FIG. 2, drop forming device 28 is a heater 51 located in a nozzle plate 49 on one or both sides of nozzle 50. This type of drop formation is known and has been described in, for example, U.S. Pat. No. 6,457,807 B1, issued to Hawkins et al., on Oct. 1, 2002; U.S. Pat. No. 6,491,362 B1, issued to Jeanmaire, on Dec. 10, 2002; U.S. Pat. No. 6,505,921 B2, issued to Chwalek et al. on Jan. 14, 2003; U.S. Pat. No. 6,554.410 B2, issued to Jeanmaire et al., on Apr. 29, 2003; U.S. Pat. No. 6,575,566 B1, issued to Jeanmaire et al., on Jun. 10, 2003; U.S. Pat. No. 6,588,888 B2, issued to Jeanmaire et al., on Jul. 8, 2003; U.S. Pat. No. 6,793,328 B2, issued to Jeanmaire, on Sep. 21, 2004; U.S. Pat. No. 6,827,429 B2, issued to Jeanmaire et al., on Dec. 7, 2004; and U.S. Pat. No. 6,851,796 B2, issued to Jeanmaire et al., on Feb. 8, 2005.

Typically, one drop forming device 28 is associated with each nozzle 50 of the nozzle array. However, a drop forming device 28 can he associated with groups of nozzles 50 or all of nozzles 50 of the nozzle array.

When printhead 30 is in operation, drops 54, 56 are typically created in a plurality of sizes, for example, in the form of large drops 56, a first size, and small drops 54, a second size. The ratio of the mass of the large drops 56 to the mass of the small drops 54 is typically approximately an integer between 2 and 10. A drop stream 58 including drops 54, 56 follows a drop path or trajectory 57.

Printhead 30 also includes a gas flow deflection mechanism 60 that directs a flow of gas 62, for example, air, past a portion of the drop trajectory 57. This portion of the drop trajectory is called the deflection zone 64. As the flow of gas 62 interacts with drops 54, 56 in deflection zone 64 it alters the drop trajectories. As the drop trajectories pass out of the deflection zone 64 they are traveling at an angle, called a deflection angle, relative to the un-deflected drop trajectory 57.

Small drops 54 are more affected by the flow of gas than are large drops 56 so that the small drop trajectory 66 diverges from the large drop trajectory 68. That is, the deflection angle for small drops 54 is larger than for large drops 56. The flow of gas 62 provides sufficient drop deflection and therefore sufficient divergence of the small and large drop trajectories so that catcher 42 (shown in FIG. 1) can be positioned to intercept the small drop trajectory 66 so that drops following this trajectory arc collected by catcher 42 while drops following the other trajectory bypass the catcher and impinge a recording medium 32 (shown in FIG. 1).

When catcher 42 is positioned to intercept small drop trajectory 66, large drops 56 are deflected by a sufficient amount to avoid contact with catcher 42 and allowing the large drops 56 to strike the print media. When catcher 42 is positioned to intercept small drop trajectory 66, large drops 56 are the drops that print, and this is referred to as large drop print mode.

Jetting module 48 includes an array or a plurality of nozzles 50. Liquid, for example, ink, supplied through channel 47, is emitted under pressure through each nozzle 50 of the array to form filaments of liquid 52. In FIG. 2, the array or plurality of nozzles 50 extends into and out of the figure.

Drop stimulation or drop forming device 28 (shown in FIGS. 1 and 2) associated with jetting module 48 is selectively actuated to perturb the filament of liquid 52 to induce portions or the filament to break off from the filament to form drops. In this way, drops are selectively created in the form of large drops and small drops that travel toward a recording medium 32.

Figure 3:
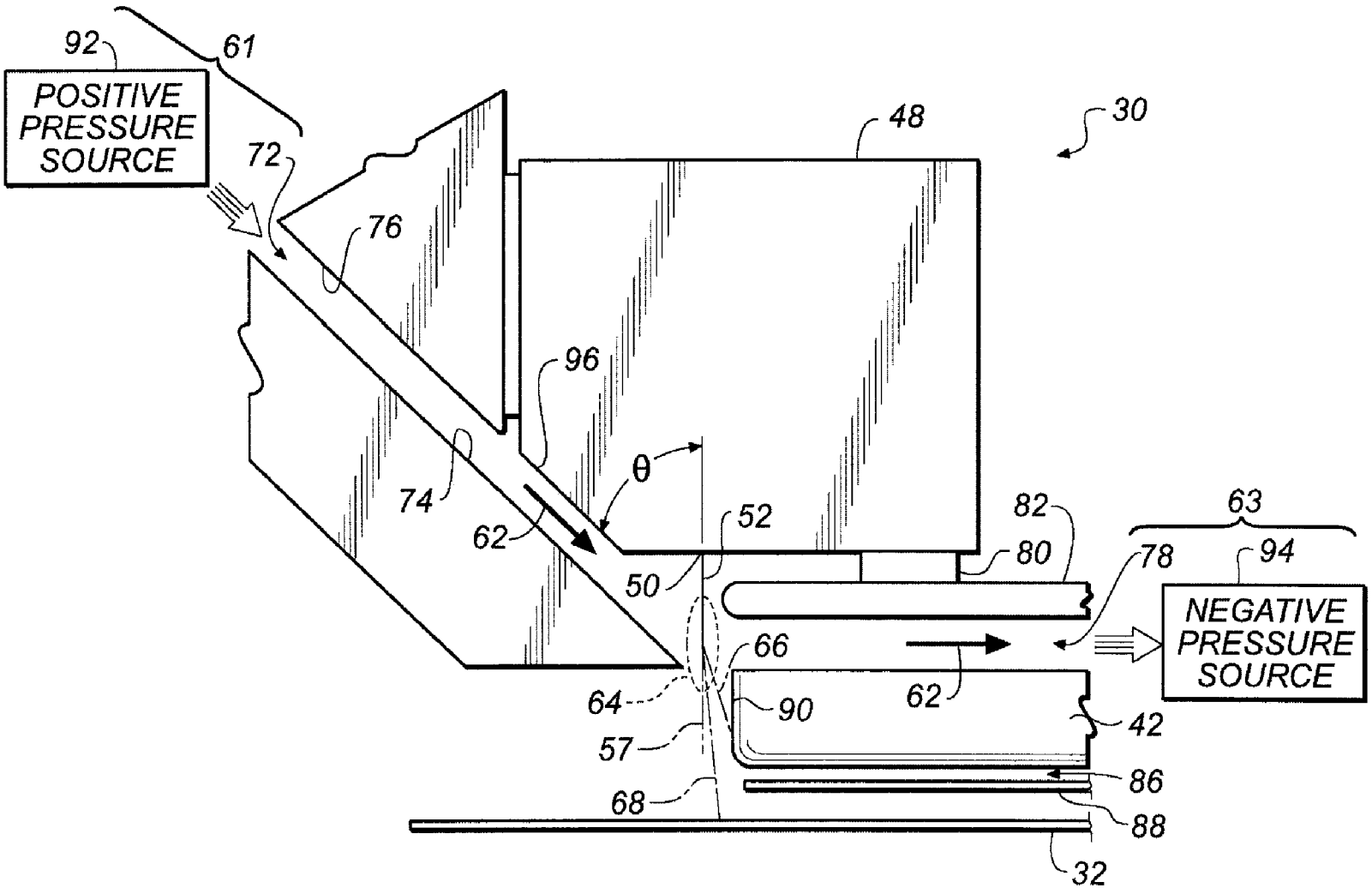
FIG. 3 is a schematic view of a simplified gas flow deflection mechanism of the present invention.

Referring to FIGS. 2 and 3, positive pressure gas flow structure 61 of gas flow deflection mechanism 60 is located on a first side of drop trajectory 57. Positive pressure gas flow structure 61 includes first gas flow duct 72 that includes a lower wall 74 and an upper wall 76. Gas flow duct 72 directs gas flow 62 supplied from a positive pressure source 92 at downward angle θ of approximately a 45° relative to liquid filament 52 toward drop deflection zone 64 (also shown in FIG. 2). An optional seal(s) 80 provides an air seal between jetting module 48 and upper wall 76 of gas flow duct 72.

Upper wall 76 of gas flow duct 72 does not need to extend to drop deflection zone 64 (as shown in FIG. 3). In FIG. 3, upper wall 76 ends at a wall 96 of jetting module 48. Wall 96 of jetting module 48 serves as a portion of upper wall 76 ending at drop deflection zone 64.

Negative pressure gas flow structure 63 of gas flow deflection mechanism 60 is located on a second side of drop trajectory 57. Negative pressure gas flow structure includes a second gas flow duct 78 located between catcher 42 and an upper wall 82 that exhausts gas flow from deflection zone 64. Second duct 78 is connected to a negative pressure source 94 that is used to help remove gas flowing through second duct 78. An optional seal(s) 80 provides an air seal between jetting module 48 and upper wall 82. As shown in FIG. 3, gas flow deflection mechanism 60 includes positive pressure source 92 and negative pressure source 94. However, depending on the specific application contemplated, gas flow deflection mechanism 60 can include only one of positive pressure source 92 and negative pressure source 94.

Gas supplied by first gas flow duct 72 is directed into the drop deflection zone 64, where it causes large drops 56 to follow large drop trajectory 68 and small drops 54 to follow small drop trajectory 66. As shown in FIG. 3, small drop trajectory 66 is intercepted by a front face 90 of catcher 42. Small drops 54 contact face 90 and flow down face 90 and into a liquid return duct 86 located or formed between catcher 42 and a plate 88. Collected liquid is either recycled and returned to ink reservoir 40 (shown in FIG. 1) for reuse or discarded. Large drops 56 bypass catcher 42 and travel on to recording medium 32. Alternatively, catcher 42 can be positioned to intercept large drop trajectory 68 while not intercepting the small drop trajectory 66. Large drops 56 contact catcher 42 and flow into a liquid return duct located or formed in catcher 42. Collected liquid is either recycled for reuse or discarded. Small drops 54 bypass catcher 42 and travel on to recording medium 32.

Referring to FIG. 2, alternatively, deflection can he accomplished by applying heat asymmetrically to filament of liquid 52 using an asymmetric heater 51. When used in this capacity, asymmetric heater 51 typically operates as the drop forming mechanism in addition to the deflection mechanism. This type of drop formation and deflection is known having been described in, for example, U.S. Pat. No. 6,079,821, issued to Chwalek et al. on Jun. 27, 2000.

As shown in FIG. 3, catcher 42 is a type of catcher commonly referred to as a "Coanda" catcher. However, the "knife edge" catcher shown in FIG. 1 and the "Coanda" catcher shown in FIG. 3 are interchangeable and work equally well. Alternatively, catcher 42 can be of any suitable design including, but not limited to, a porous face catcher, a delimited edge catcher, or combinations of any of those described above.

Figure 4:
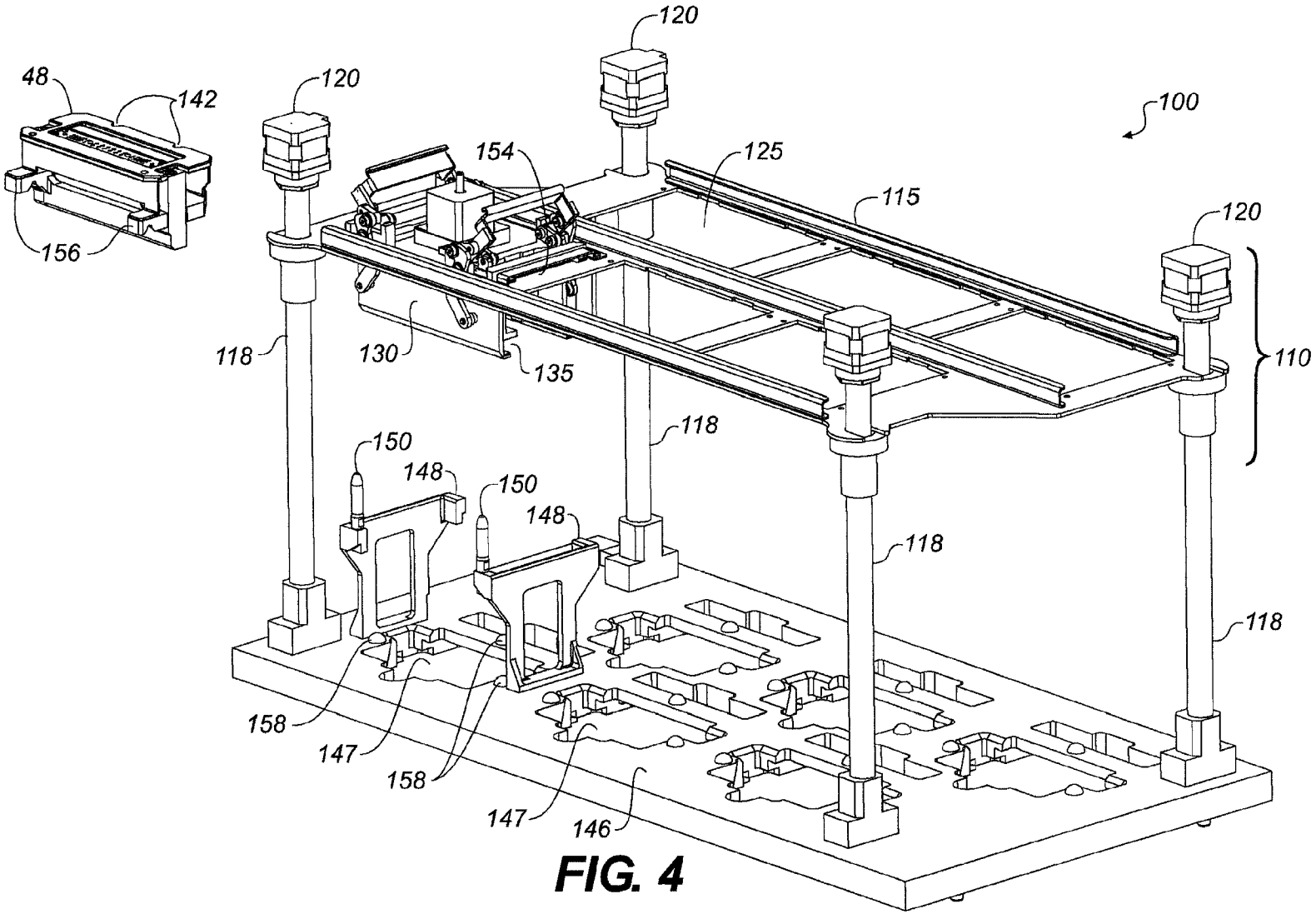
FIG. 4 is a perspective view of a portion of a printer illustrating a jetting module in its uninstalled position in an install device.

Referring to FIG. 4, there is shown a perspective view of a portion of a continuous printer illustrating the jetting module 48 in its uninstalled position for clarity in understanding the present invention. The printer 100 includes a module removing device 110 that includes a lift plate 115 and four post members 118 for supporting the lift plate. The lift plate has a plurality of openings 125 in which an install device 130 is positioned. Although only one install device is shown in FIG. 4, each opening can receive an install device. The openings 125 are shown as rectangular shaped openings, but the opening need not be limited to rectangular shaped openings. Any opening shape suitable for receiving the install devices may be used. It facilitates understanding to note that the module removing device includes other well known components in order to be operational as will he readily recognized by those skilled in the art from this description. For example, one or more motors 120 are needed for moving the lift plate upwardly and downwardly.

Each install device includes a pocket 135 for receiving the jetting module 48. The pocket 135 is seen most clearly in FIG. 10, where the jetting module 48 is shown centered in the pocket 135. The install device 130 preferably includes detents 140 that engage features 142 on the jetting module 48 to center the jetting module 48 within the pocket 135. The install device also includes a latch mechanism 144 comprised of two latch devices as will be described more fully later herein.

Returning to FIG. 4, a printhead frame 146 of the printhead 30 supports the four posts 118 of the module removing device 118 and includes a plurality of jetting-module receiving receptacles 147 each aligned with a corresponding opening 125 of the lift plate 115. The printhead frame 146 also includes two upwardly extending mating portions 148 positioned on opposite ends of each receiving receptacles 147, although only one pair is shown for drawing clarity. The mating portions 148 matingly receive the install device 130 and each includes a post 150 so that the install device aligns properly as it is lowered onto the printhead frame 146, as will be discussed more fully later herein.

Figure 5:
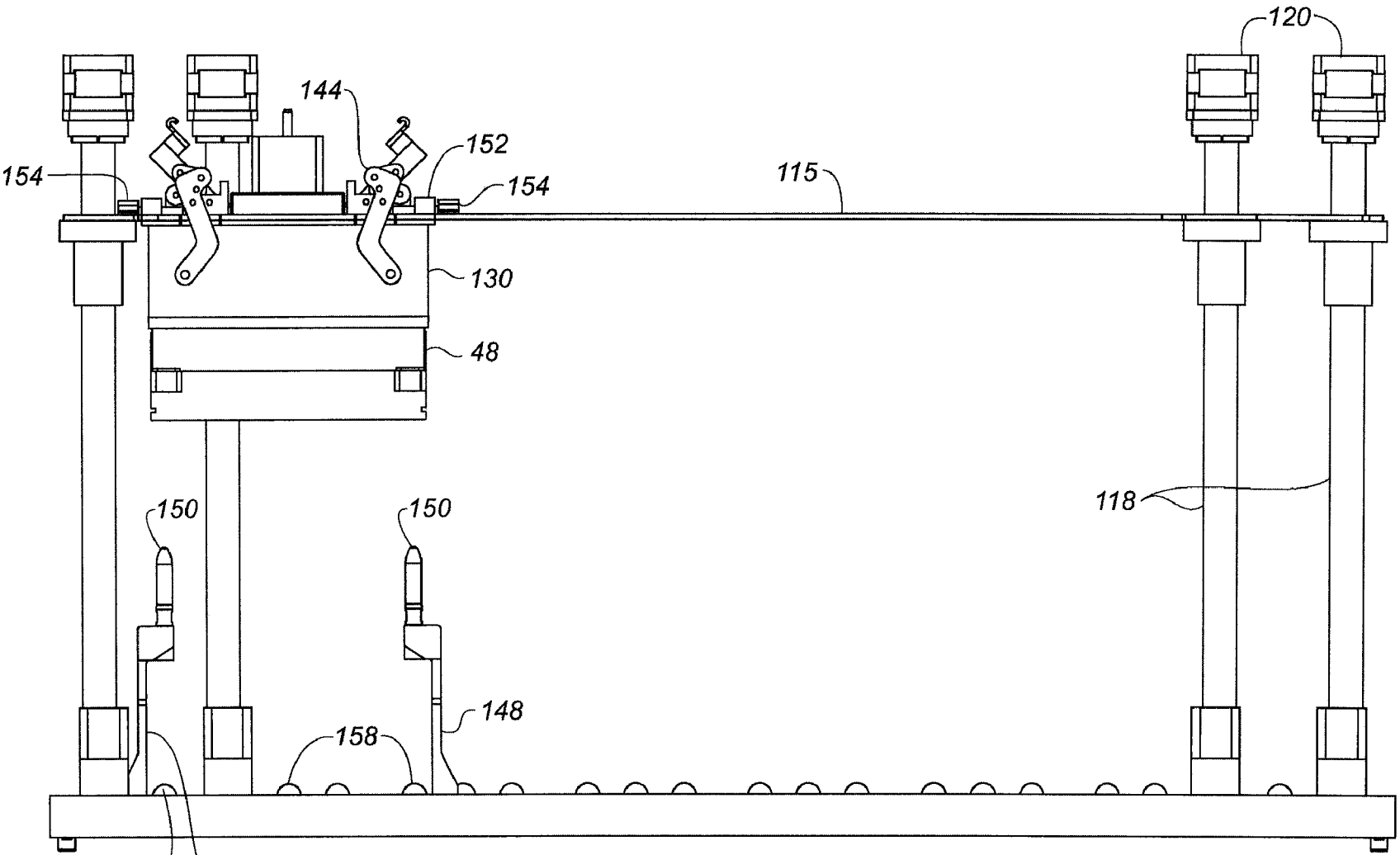
FIG. 5 is a front view of the install device with the jetting module installed therein in which the install device is yet to he installed on the printhead.

Referring to FIG. 5, there is shown a front view of the jetting module 48 installed within an install device 130. The install device 130 is located in one of the openings 125 of the lift plate 115 of the module removing device 110 module removing device and is secured to the lift plate 115 of the module removing device 110 by the latch mechanism 144. The latch mechanisms 144 cause a first latch device 152 of the latch mechanism 144 to extend out the sides of the install device 130. The first latch device 152 is trapped in catch 154 of the lift plate 115. This ensures the stability of the install device 130 as the lift plate 115 of the module removing device 110 is lowered downwardly.

As the lift plate 115 of the module removing device 110 is lowered, the posts 150 of the upwardly extending mating portions 148 engage the install device 130. The first latch device 152 that secures the install device 130 to the lift plate 115 allows the install device 130 to shift around within the rectangular shaped opening 125 so that the install device 130 may be guided by the posts 150 as it is lowered. As a result of lowering the install device 130, the jetting module 48, located in the pocket 135 of the install device 130, is correspondingly lowered into its installed position as shown in FIG. 6.

Figure 6:
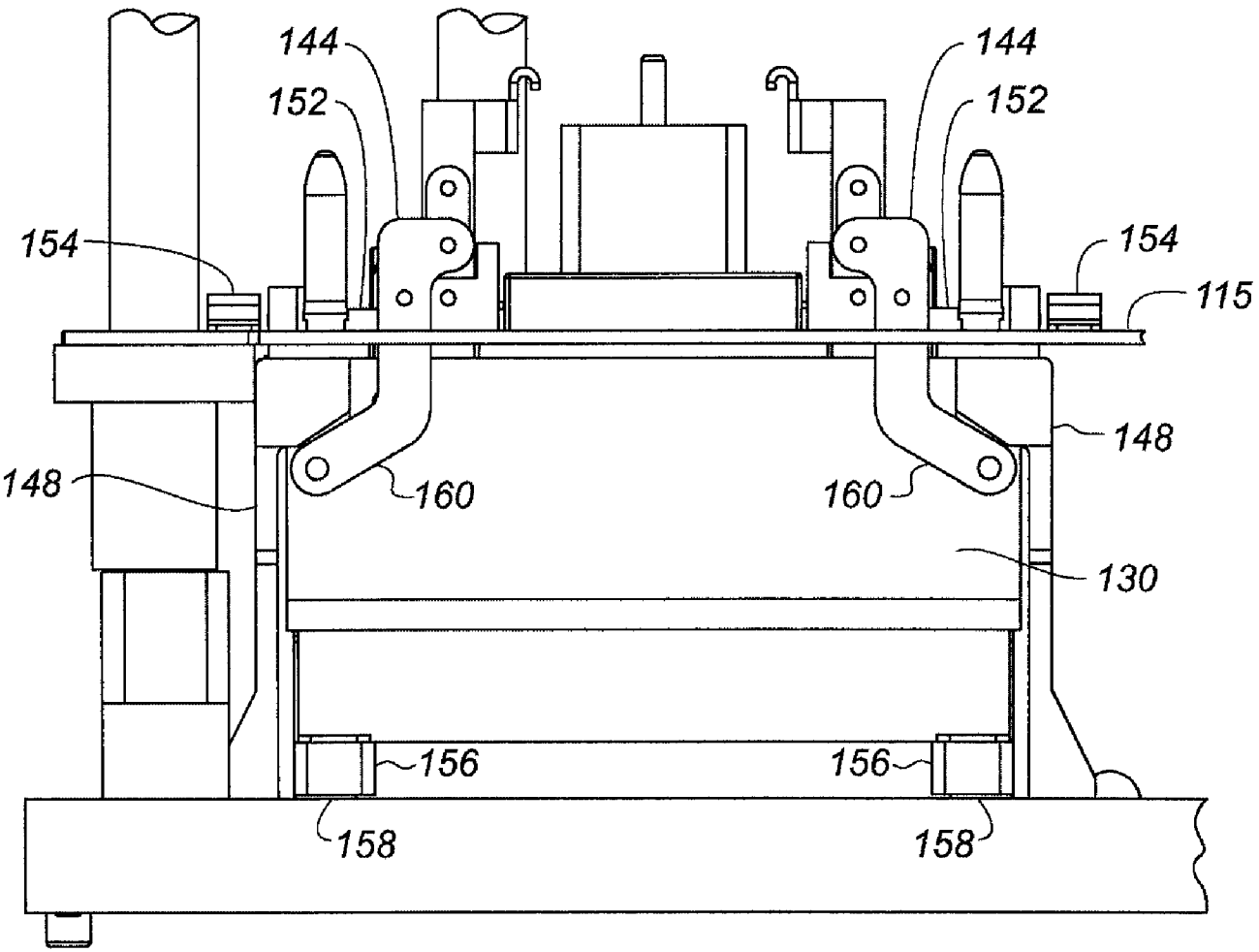
FIG. 6 is a front view of the install device installed on the printhead.

Referring to FIGS. 5 and 6, since the jetting module 48 has been centered, in the pocket 135 of the install device 130 by the detents 140, and the install device 130 has been guided by the posts 150 as it was lowered, the jetting module 43 is located appropriately so that the first alignment features 156 of the jetting module 48 will properly engage the second alignment features 158 of the printhead frame 146. The detents 140 that locate the jetting module 48 in the pocket 135 provide sufficient compliance so that the jetting module position will he determined by the engagement of the first and second alignment features 156 and 158 rather than by the detent mechanism of the install device 130.

Referring to FIG. 6, there is shown the lift plate 115 of the module removing device 110 after it has been lowered downwardly onto the printhead frame 146 so that the two mating portions 148 are mated to the install device 130. The latch mechanisms 144 are then moved which cause the first latch device 152 to retract from the catch 154. This unlatches the install device 130 from the lift plate 115 of the module removal device 110. Concurrently, the latch mechanism 144 causes a second latch device 160 to secure the install device 130 to the printhead frame 146 by engaging the mating portions 148.

Figure 7:
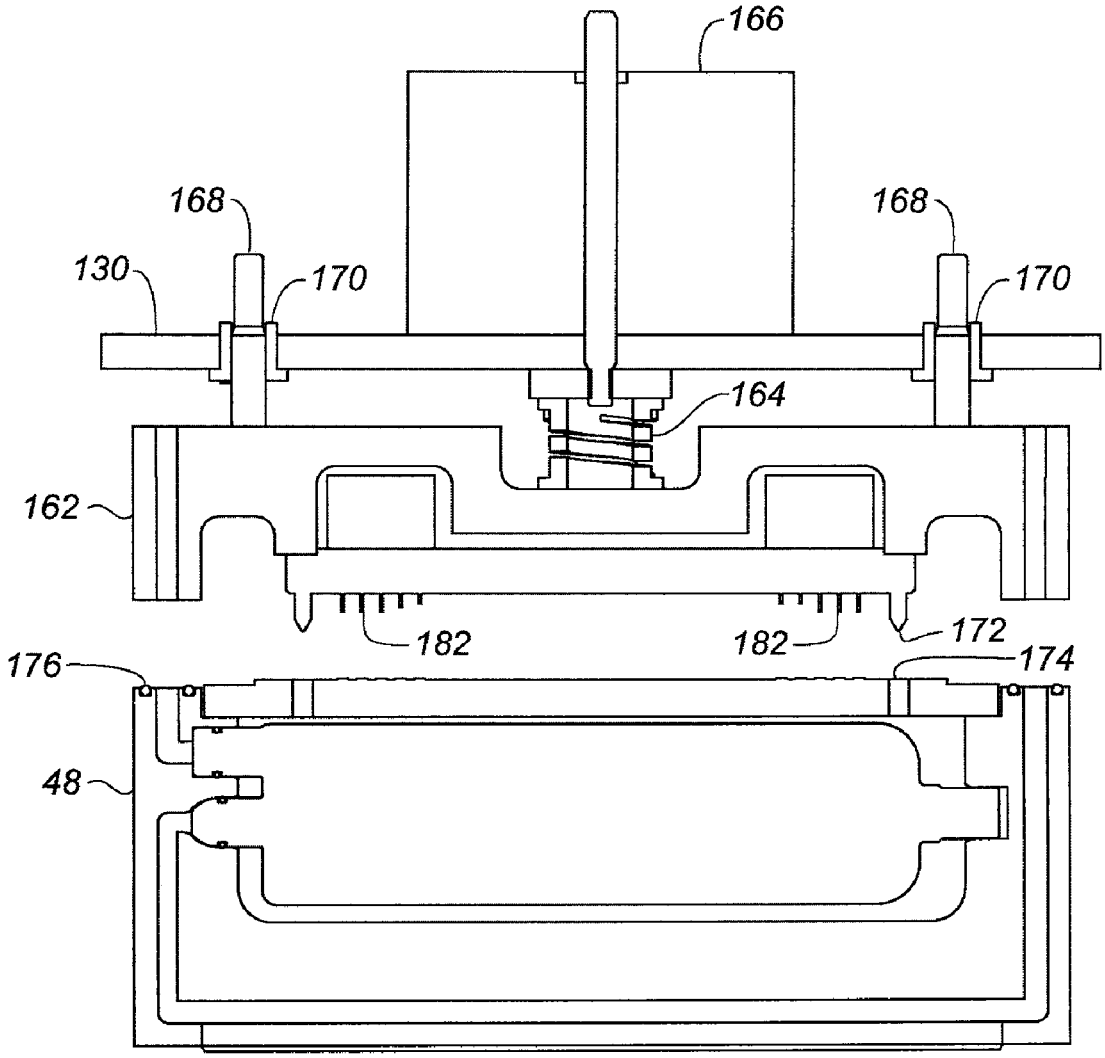
FIG. 7 is a front view of the install device having a coupling frame that is being installed onto the jetting module.

Referring to FIG. 7, after the jetting module 48 has been properly positioned in the jetting module receiving receptacle 147, the coupling frame portion 162 of the install device 130 is employed to make fluid and electric connections to the jetting module 48. A compliant coupling mechanism 164, shown here as a spring, is used to mount the coupling frame to an actuator 166 of the install device 130. FIG. 7 shows the relationship between the coupling frame 162 and the jetting module 48 when the coupling frame is fully retracted away from the jetting module 48. The coupling frame 162 would be in this position whenever the install device 130 is not latched to the printhead frame 146, for example such as in FIG. 5. In this embodiment, the actuator 166 comprises a motor actuator, but other actuators could he employed such as over-center linkage systems or the like. The compliant coupling of the coupling frame 162 enables the coupling frame 162 to align itself with the jetting module 48 so that necessary fluid and electrical connections can be made to the jetting module 48 without compromising the integrity of the kinematic mount of the jetting module 48 to the printhead frame 146. The coupling frame 162 includes first guiding features 168 that engage corresponding second guiding features 170 of the install device 130. These guiding features 168 and 170 serve to pre-align the coupling frame 162 to the jetting module 48. The detents 140 mentioned earlier that center the jetting module 48 within the pocket 135 of the install device 130 also serve to ensure that the coupling frame 162 is pre-aligned to the jetting module 48.

Figure 8:
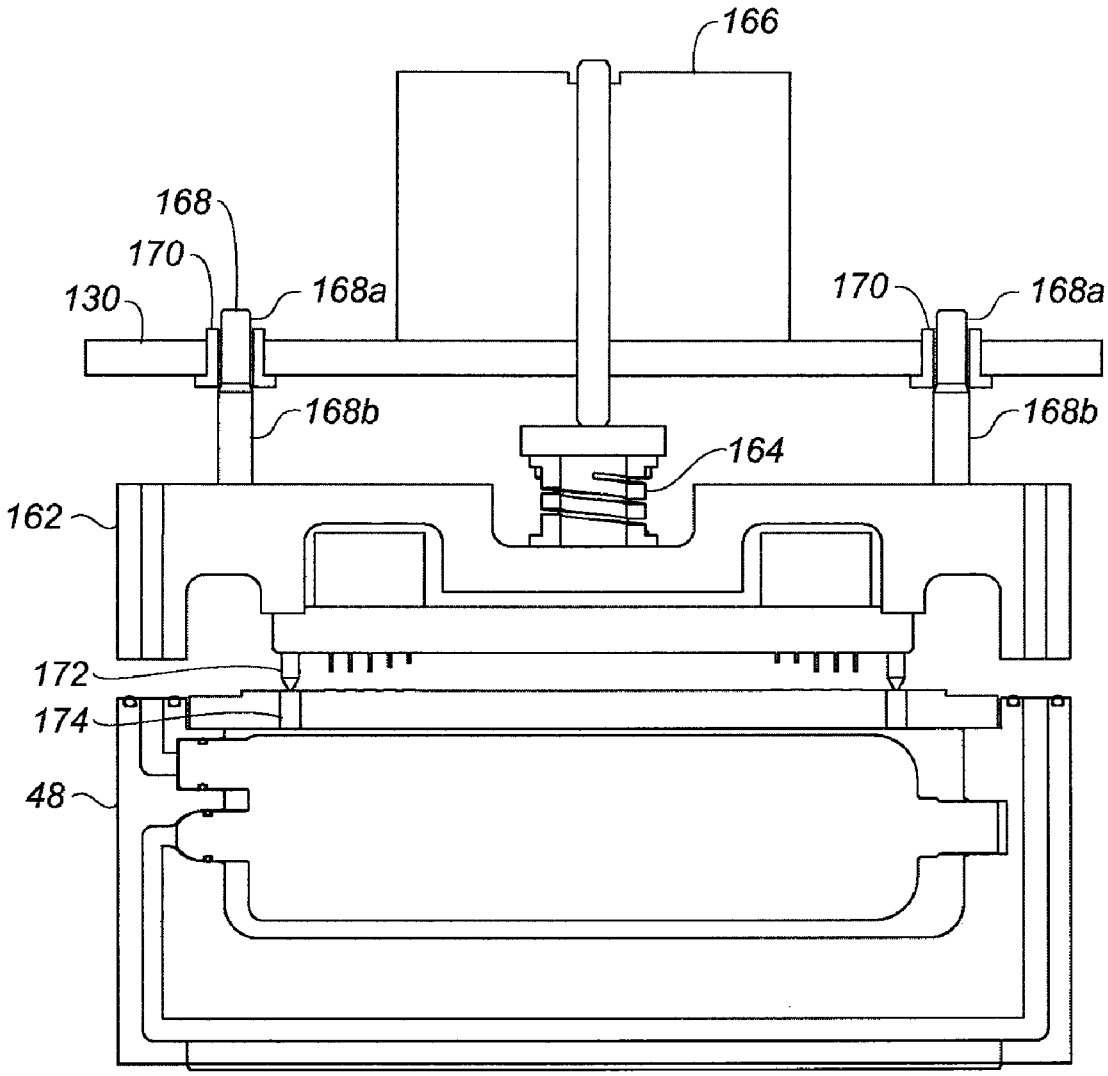
FIG. 8 is a front view of the coupling frame partially installed onto the jetting module.

FIG. 8 illustrates the respective relationships of the coupling frame 162 and the jetting module 48 as the coupling frame 162 has been displaced toward the jetting module 48 by the actuator 166. The coupling frame 162 is beginning to engage the jetting module 48. As shown, the coupling frame 162 includes alignment posts 172 that engage corresponding recess portions 174 of the jetting module 48 to align the coupling frame 162 to the jetting module 48. Once the alignment posts 172 engage the corresponding recesses 174 of the jetting module 48, it is no longer necessary for the coupling frame 162 to be guided by the pre-alignment guiding features 168. The diameter of the upper portion 168*a* of the guiding features 168 is smaller than the diameter of the lower portion 168*b* of the guiding features 168 to provide additional clearance between the first guiding features 168 and the corresponding second guiding features 170 of the install device 130 so that the guiding features 168 no longer serve to align the coupling frame 162 when the posts 172 of the coupling frame 162 engage the corresponding recesses 174 of the jetting module 48.

Figure 9:
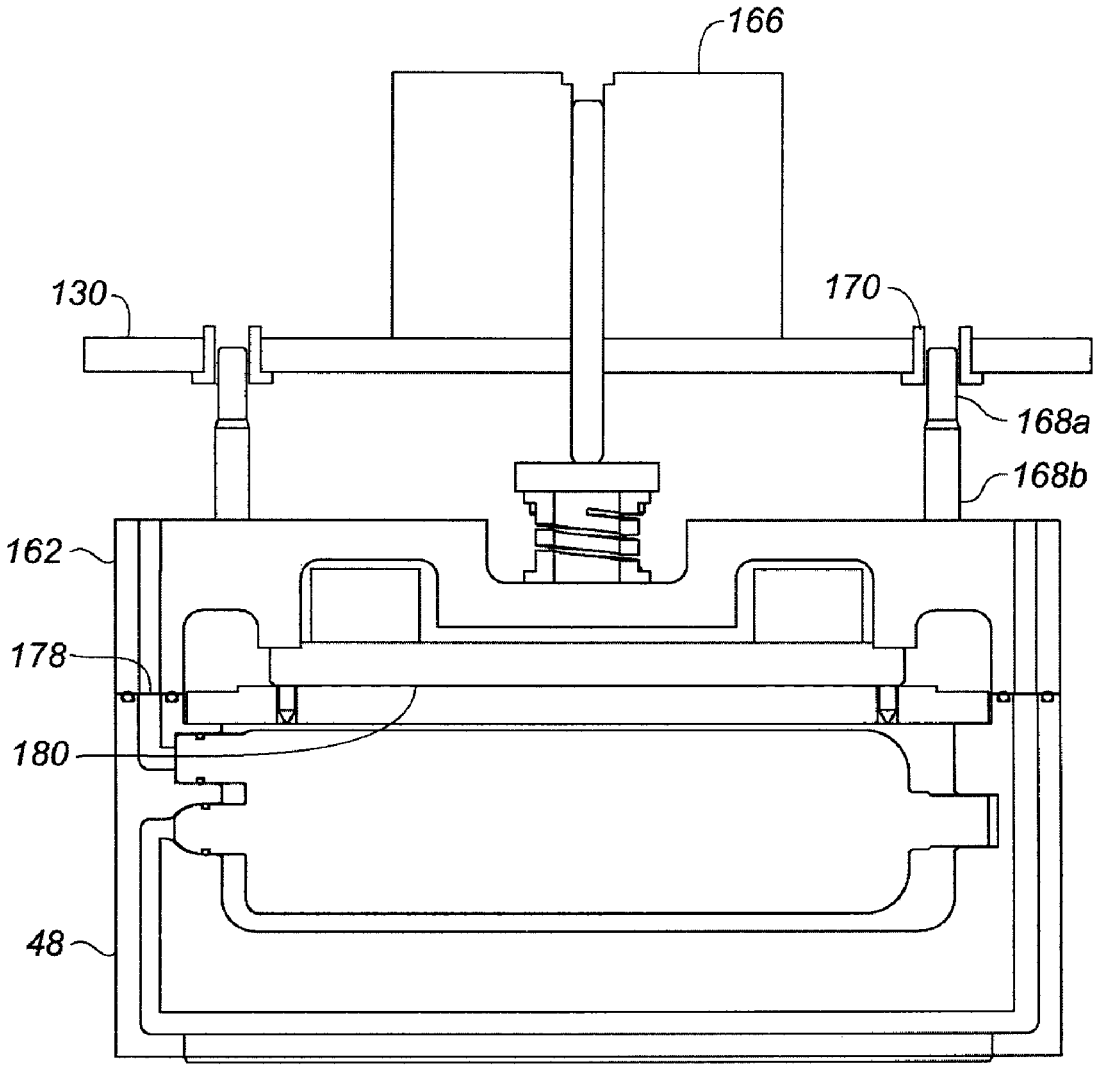
FIG. 9 is a front view of the coupling frame fully installed onto the jetting module.

FIG. 9 shows the coupling frame 162 contacting the jetting module 48 to make all the required fluid and electrical connections, 178 and 180 respectively. O-rings 176 are used to produce leak free seals at the fluid connections 178 between the coupling frame 162 and the jetting module 48. The electrical contacts of the coupling frame 162 comprise spring biased contact pins 182 (see FIG. 7). The length of the contact pins 182 can he varied as shown in FIG. 7 to ensure that the various electrical connections are made in the desired sequence order.

Figure 10:
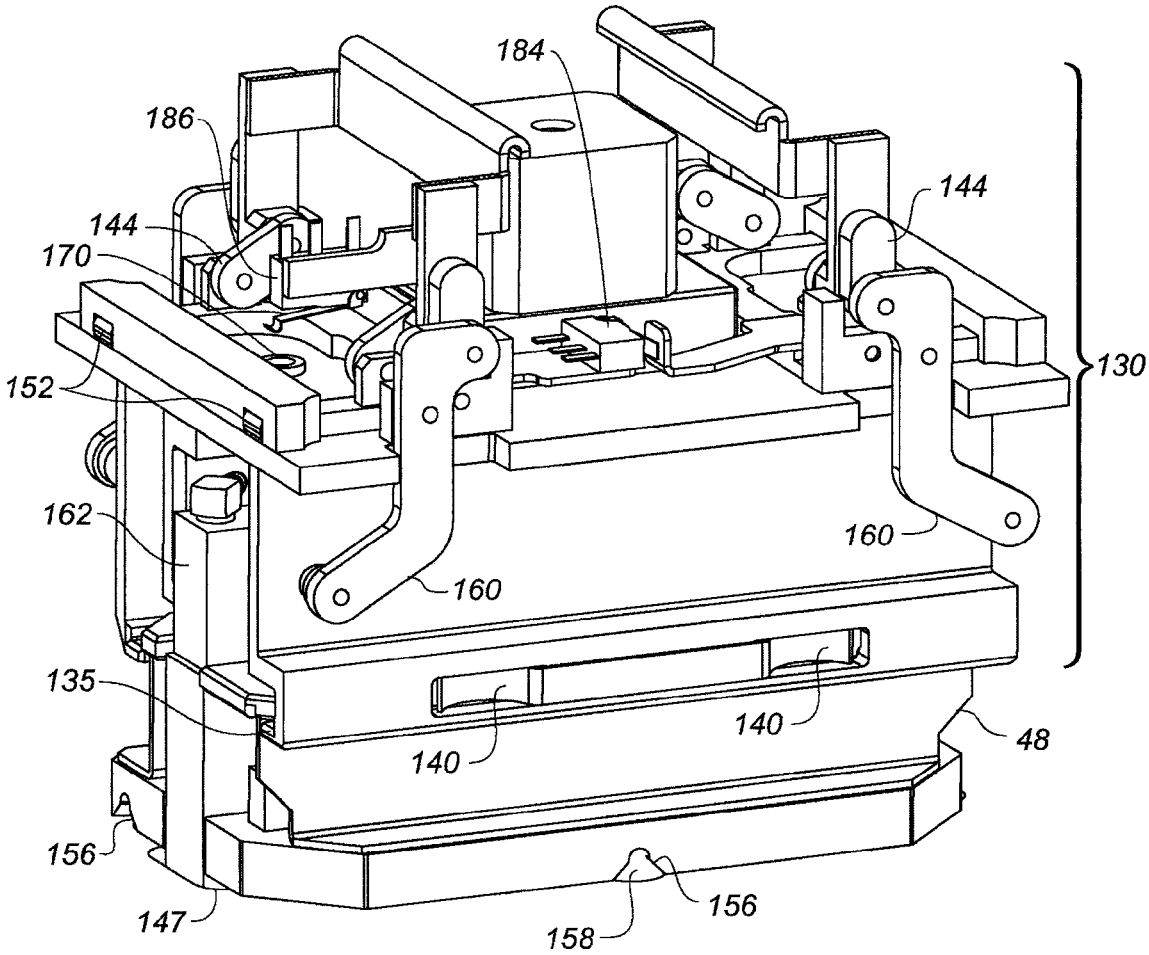
FIG. 10 is a perspective view of the install device, jetting module and coupling frame also in its fully installed position.

Referring to FIG. 10, there is shown the jetting module 48 in the pocket 135 of the install device 130. The jetting module is also located in a receiving receptacle 147 of the printhead frame 146 with the alignment features 156 of the jetting module engaging the corresponding alignment features 158 of the printhead frame 146. (The drop deflection mechanism is not shown to enable the relationship between the jetting module 48, printhead frame 146 and the install device 130 to he seen.) The second latch device 160 of the latch mechanism 144 of the install device 130 engages the mating portions 148 to secure the install device 130 to the printhead frame 146. The coupling frame 162 is shown lowered into position to provide the fluid and electrical connections to the jetting module 48. The coupling frame 162 provides downward force to the jetting module 48 to hold the jetting module in place with the alignment features 156 of the jetting module 48 properly engaging the corresponding alignment features 158 of the printhead frame 146. The install device 130 may include one or more signal indicators, such as sensors or switches, to provide signals to the printer controller (not shown) as to the install condition of the jetting modules 48. For example switch 184 is used as first signal indicator to signal that the install device 130 is latched to the mating portions by the second latch device 160. Similarly, electrical signals passing through the coupling frame 162 to the jetting module and back to the coupling frame 162 through the electrical connections can serve as a second signal indicator to signal that the coupling frame 162 is properly coupled to the jetting module 48. When the coupling frame 162 is fully retracted from the jetting module 48 (not the state shown in FIG. 10) the end of the first guiding feature 168, which is attached to the coupling frame 162, will protrude through second guiding member 170 of the install device body to contact switch 186, which then provides a signal indicating that condition to the controller. The printer controller may use such signals to ensure the install/uninstall sequences are progressing properly. For example, the printer controller that controls the fluid system can impede the flow of ink to the coupling frame when a first signal indicator indicates the jetting module is not properly secured to the printhead frame and the second signal indicator indicates that the coupling frame is not properly coupled to the jetting module. Similarly, when the printer controller receives signals from the fluid system that fluid is being supplied under pressure to a jetting module, it can act to prevent the actuator 166 displacing the coupling frame away from the jetting module.

The invention has been described in detail with particular reference to certain preferred embodiments thereof, but it will be understood that variations and modifications can be effected within the spirit and scope of the invention.

Parts List

20 continuous ink jet printer system
22 image source
24 image processing unit
26 mechanism control circuits
28 device
30 printhead
32 recording medium
34 recording medium transport system
36 recording medium transport control system
38 micro-controller
40 reservoir
42 catcher
44 recycling unit
46 pressure regulator
47 channel
48 jetting module
49 nozzle plate
50 plurality of nozzles
51 heater
52 liquid
54 drops
55 drops
56 drops
57 trajectory
58 drop stream
60 gas flow deflection mechanism
61 positive pressure gas flow structure
62 gas
63 negative pressure gas flow structure
64 deflection zone
66 small drop trajectory
68 large drop trajectory
72 first gas flow duct
74 lower wall
76 upper wall
78 second gas flow duct
80 optional seal(s)
82 upper wall
86 liquid return duct
88 plate
90 front face
92 positive pressure source
94 negative pressure source
96 wall
100 printer
110 module removal device
115 lift plate
118 post member
120 motor
125 rectangular Shaped Openings
130 install Device
135 pocket
140 detent
142 feature
144 latch mechanism
146 printhead frame
147 receiving receptacle
148 mating portion
150 post
152 first latch device
154 catch
156 first alignment feature
158 second alignment feature
160 second latch device
162 coupling frame
164 compliant coupling mechanism
166 actuator
168 first guiding feature
168*a* upper portion
168*b* lower portion
170 second guiding feature
172 alignment post
174 recess portion
176 O-ring
178 fluid Connection
180 electrical Connection
182 contact pins
184 switch
186 switch

The invention claimed is:

1. A printer comprising:

(a) a plurality of jetting modules each including a first alignment feature, a plurality of nozzles through which fluid may be jetted and fluid and electrical connections;

(b) a printhead frame having a plurality of jetting-module receiving receptacles each of which receives one of the jetting modules, each receiving receptacle having a second alignment feature corresponding to the first alignment feature of a jetting module;

(c) a jetting module installation device having a pocket for receiving a jetting module, wherein the jetting module installation device includes a latch mechanism that, in a first position, is latched to the printhead frame securing the jetting module in a jetting module receiving receptacle with the first alignment feature engaging a corresponding second alignment feature of the printhead frame;

(d) the latch mechanism that, in a second position, is unlatched from the printhead frame so that the jetting module is not secured in the jetting module receiving receptacle; and wherein the jetting module installation device includes a coupling frame having fluid and electrical connections that correspond to the fluid and electrical connections of the jetting module, and the installation device includes a mechanism move the coupling frame relative to the jetting module to cause the fluid and electrical connections of the coupling frame to mate to the fluid and electrical connections of the jetting module.

2. The printer as in claim 1, wherein the jetting module installation device includes a third alignment feature which engages a fourth alignment feature of the printhead frame.

3. The printer as in claim 1, wherein the printhead includes a drop deflection mechanism and the jetting module includes a drop generator for creating drops of which a portion of the drops are deflected away from a print media.

4. The printer as in claim 1 wherein the coupling frame includes guiding features to pre-align the fluid and electrical connections of the coupling frame with corresponding connections of the jetting module.

5. The printer as in claim 4, wherein the coupling frame includes fifth alignment features that correspond to sixth alignment features of the jetting module.

6. The printer as in claim 5, wherein the guiding features include a relief so that the guiding features no longer provide guidance after the fifth and sixth alignment features become engaged.

7. The printer as in claim 1, wherein, when the latch of the installation is in the second position, the installation device is latched to a module removing device.

8. The printer as in claim 7, wherein the module removing device includes a mechanism to displace the installation device and the jetting module relative to the printhead frame.

9. The printer as in claim 7, wherein one or more jetting modules may be replaced without affecting any of the other installed jetting modules.

10. The printer as in claim 1 further comprising a signal indicator which indicates whether the jetting module is secured to the printhead frame by means of the latch of the installation device.

11. The printer as in claim 10 further comprising a mechanism for receiving a signal from the signal indicator and impedes the flow of ink to the coupling frame when the signal indicator indicates the jetting module is not properly secured.

12. The printer as in claim 1 further comprises a second signal indicator which indicates whether the fluid and electrical connections of the coupling are mated with the corresponding fluid and electrical connections of the jetting module.

13. The printer as in claim 1 further comprises a mechanism to prevent the mechanism from moving the coupling frame relative to the jetting module when the fluid is supplied under pressure to the jetting module.

14. A printing assembly for use in a continuous inkjet system, the printing assembly comprising:

(a) a jetting module installation device having a pocket for receiving a jetting module;

(b) a jetting module disposed in the pocket of the installation device, the jetting module having a plurality of nozzles and fluid and electrical connections;

wherein the jetting module installation device includes a coupling frame having fluid and electrical connections that correspond to the fluid and electrical connections of the jetting module, and the installation device includes a mechanism to move the coupling frame relative to the jetting module to cause the fluid and electrical connections of the coupling frame to mate to the fluid and electrical connections of the jetting module;

(c) a first mating feature on the coupling frame that mates with a second mating feature on the jetting module that aligns the fluid and electrical connections of the coupling frame to the corresponding fluid and electrical connections of the jetting module.

15. The printing assembly as in claim 14 further comprising a first guiding feature on the install device that mates with a second guiding feature on the coupling frame for guiding the coupling frame into proper position for mating with the jetting module.

16. The printing assemble as in claim 14 further comprising a compliant mechanism on the coupling frame that causes the coupling frame to self-level relative to the jetting module.

17. The printing assembly as in claim 14, wherein the mechanism to move the coupling frame relative to the jetting module is a motor.

18. The printing assembly as in claim 14 further comprising a signal indicator which indicates whether the fluid and electrical connections of the coupling frame are mated with the corresponding fluid and electrical connections of the jetting module.

19. The printing assembly as in claim 14 further comprising a latch that functions to secure the printing assembly to a printhead frame.

* * * * *